US009926736B2

(12) United States Patent
Clarke, Jr.

(10) Patent No.: US 9,926,736 B2
(45) Date of Patent: Mar. 27, 2018

(54) ADJUSTABLE DOOR FRAME

(71) Applicant: Frame & Mullions, LLC, Henrico, VA (US)

(72) Inventor: James Thomas Clarke, Jr., Henrico, VA (US)

(73) Assignee: Frame & Mullions, LLC, Henrico, VA (US)

( * ) Notice: Subject to any disclaimer, the term of this patent is extended or adjusted under 35 U.S.C. 154(b) by 0 days.

(21) Appl. No.: 15/443,491

(22) Filed: Feb. 27, 2017

(65) Prior Publication Data

US 2017/0254138 A1 Sep. 7, 2017

Related U.S. Application Data

(60) Provisional application No. 62/302,367, filed on Mar. 2, 2016.

(51) Int. Cl.

| | |
|---|---|
| ***E06B 1/60*** | (2006.01) |
| ***E06B 1/52*** | (2006.01) |
| ***E04F 21/00*** | (2006.01) |

(52) U.S. Cl.

CPC ..... *E06B 1/6076* (2013.01); *E04F 21/0015* (2013.01); *E06B 1/52* (2013.01)

(58) Field of Classification Search

CPC ... E06B 1/6076; E06B 1/6069; E04F 21/0015

See application file for complete search history.

(56) References Cited

U.S. PATENT DOCUMENTS

| | | | | |
|---|---|---|---|---|
| 3,999,339 | A * | 12/1976 | Sappenfield | E06B 1/60 411/43 |
| 6,532,705 | B1 * | 3/2003 | Gorman | E06B 1/6015 52/212 |
| 7,987,637 | B2 * | 8/2011 | Smith | E06B 1/6076 411/388 |
| 9,194,170 | B2 * | 11/2015 | Eis | E06B 1/603 |
| 2005/0081473 | A1 * | 4/2005 | MacDonald | E06B 1/6076 52/633 |

* cited by examiner

*Primary Examiner* — Andrew J Triggs

(74) *Attorney, Agent, or Firm* — John H. Thomas, P.C.

(57) ABSTRACT

A door frame assembly includes integral shim screws in the vertical jambs that facilitate installation of the assembly into a rough opening or doorway. The vertical frame jambs have one or more holes therethrough. Shim screws are positioned in those apertures and are adjustably extendable outwardly therefrom to engage a rough opening to assist in fixing the frame in that opening.

9 Claims, 8 Drawing Sheets

ADJUSTABLE DOOR FRAME

This application claims the benefit of United States Provisional Application No. 62/302,367, filed Mar. 2, 2016, which is incorporated by reference herein in its entirety.

The present invention is directed to door frame assemblies. Specifically, the invention is directed to a frame that incorporates integral shim screws that facilitate and expedite the installation of a door frame into a rough opening of a building or a room inside a building.

BACKGROUND

The construction and installation of door systems generally require very old and well-known carpentry skills that have been practiced widely with multiple types of door systems for many years. Traditionally, a construction project includes rough masonry openings as well as for instance rough, or cased, openings for doors in aluminum curtain wall and store front systems in the exterior and interior walls of a building. Door assemblies may be custom fabricated to fit these opening. More typically, however, prefabricated door and frame systems are installed in these rough openings. During the installation process, shims are used with anchor screws to secure and fix the door and frame system in its proper position in the rough opening. This installation process can be extremely labor intensive, and time consuming, since the positioning of the door, or doors, in the frame directly affects their operation. It is also easy to undertake this installation incorrectly.

SUMMARY

Accordingly, it is an object of the present invention to provide a new door frame assembly and to improve and facilitate the installation of a door frame within a rough opening and overcome the drawbacks of the present, traditional shim methods of installation.

In one example, a door frame assembly comprises vertical frame jambs each having a top end and bottom end, one vertical frame jamb on each side of a door frame assembly and adapted to be installed in a substantially vertical position. Each vertical frame jamb has a width between an inside face exposed to the open doorway and an outside face adapted to be exposed to a rough door opening. A horizontal frame header is butted and connected on opposite ends thereof to the top end of each vertical frame jamb. The vertical frame jambs are hollow rectangular tubes and each have at least one aperture at the top and bottom of each jamb therein that extends through and is open on both the inside face and outside face of the vertical frame jamb. Shim plates are sized to fit inside the hollow metal rectangular tubes into the hollow space between the inside face and the outside face of the apertures that extend through the vertical frame jambs, and further wherein the threaded shim plates may comprise apertures that align with the apertures on the inside face and outside face of the vertical frame jamb. A shim screw is adapted to be mounted through the aperture and into the shim plate and is further adapted to be adjustable so that it may be threaded through the shim plate to extend outwardly from the outside face of the vertical frame jamb to variably engage a rough door opening surface. Each vertical door jamb may have two apertures with one aperture positioned proximate the top end and bottom end of each vertical frame jamb. The length of each shim screw may be substantially equal to the width of each corresponding vertical frame jamb. The vertical frame jambs may be comprised of metal, optionally formed from aluminum or steel. The shim screw may be an internal drive screw having a drive end that is open to the inside face of the vertical frame jamb. The shim screw may threaded into the shim plate, and it may, or alternatively may not, extend outwardly from the inside face of the vertical frame jamb.

DESCRIPTION

Figure 1:
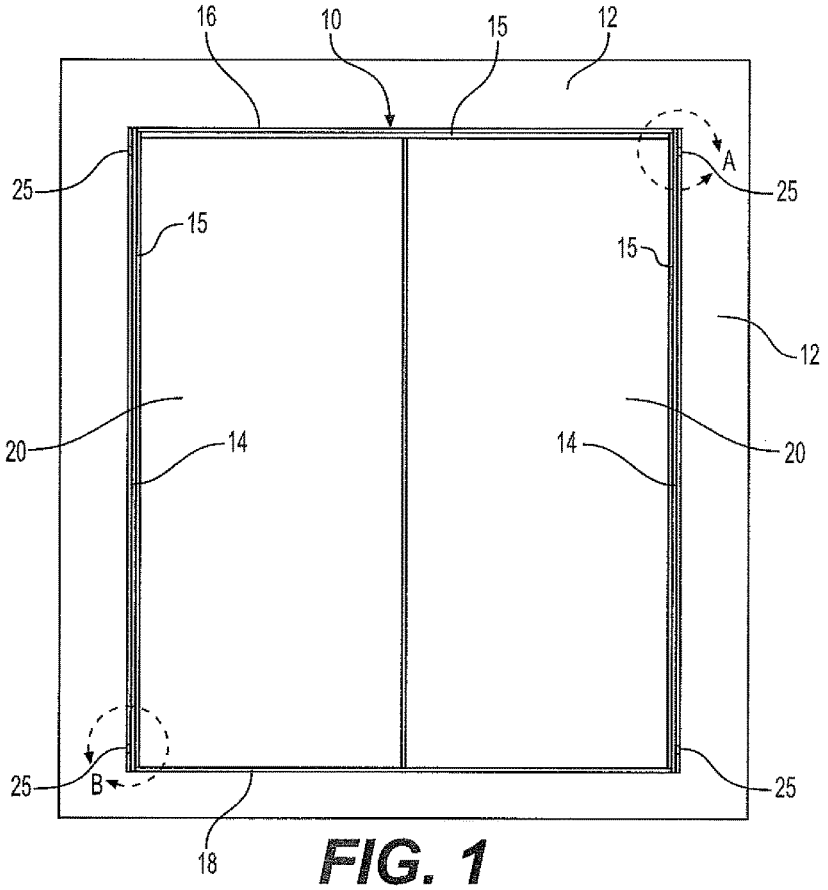
FIG. 1 is a front view of a pair of doors within an example of an adjustable door frame assembly as described herein. Detail A of FIG. 1 is illustrated in a close-up front view in FIG. 1A. Detail B of FIG. 1 is illustrated in a close-up perspective view in FIG. 1B.
Figure 1A:
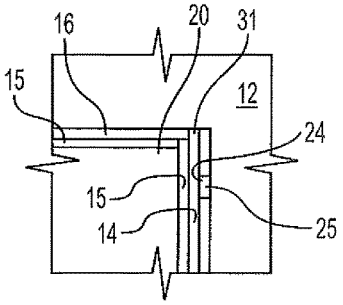
Figure 1B:
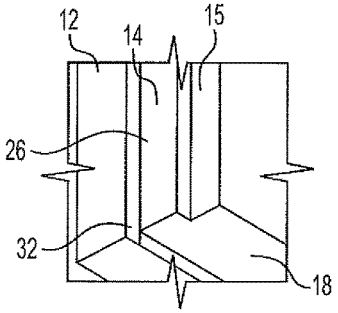
Figure 2:
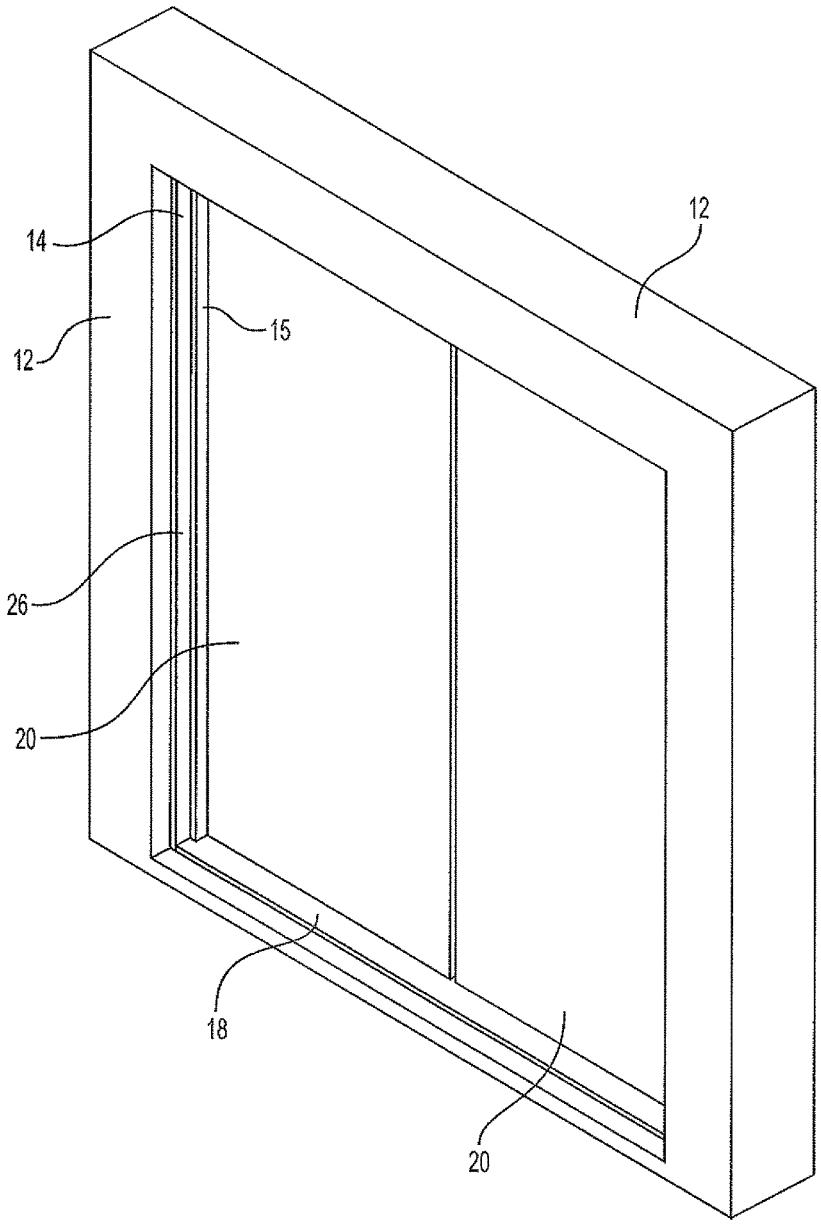
FIG. 2 is a perspective view of the adjustable door frame assembly shown in FIG. 1.
Figure 3:
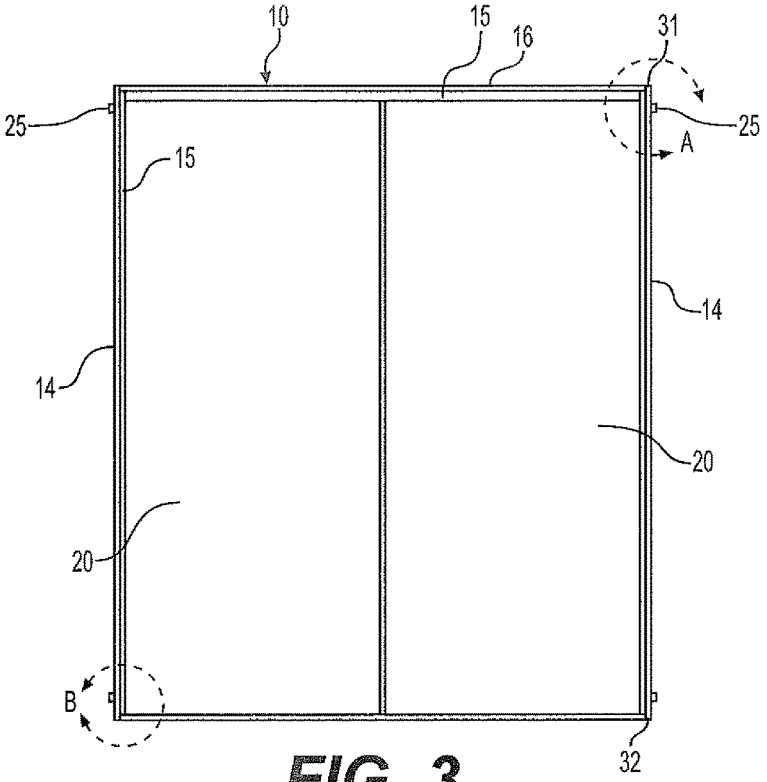
FIG. 3 is a front view of the pair of doors within an adjustable door frame assembly apart from any sub-frame. Detail A of FIG. 3 is illustrated in a close-up front view in FIG. 3A. Detail B of FIG. 3 is illustrated in a close-up perspective view in FIG. 3B.
Figure 3A:
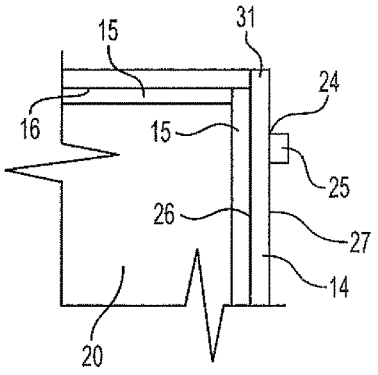
Figure 3B:
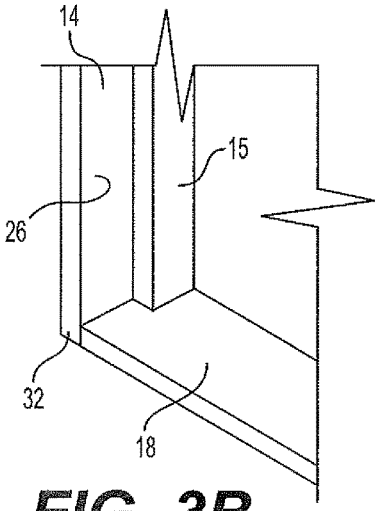
Figure 4:
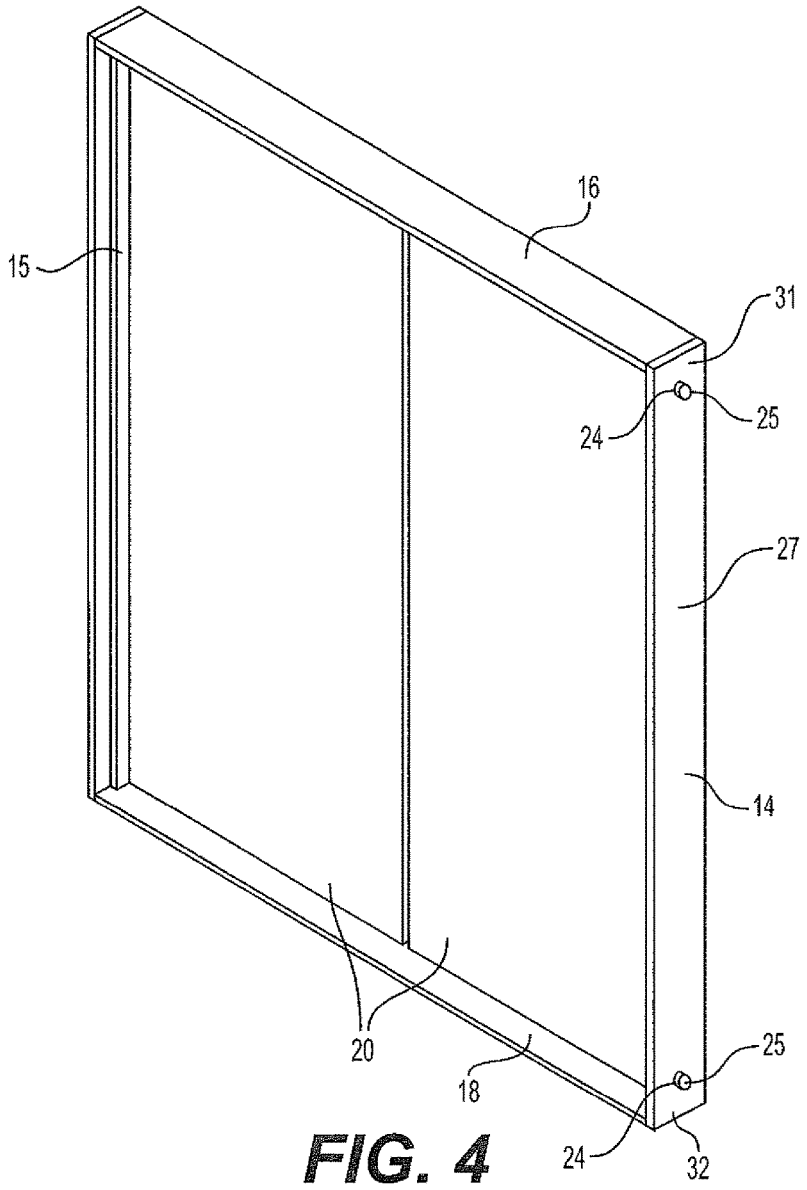
FIG. 4 is a perspective view of the adjustable door frame assembly shown in FIG. 3.

The door frame assembly described herein is designed to incorporate integral shim screws that may be permanently employed to position and secure a frame during the installation process. The vertical rectangular tubes on each side of an opening are the vertical frame jambs, and are also referred to as door jambs. Essential to their function they have apertures through both the inside and outside walls of the jambs across their thickness at two or more locations along the height or length of the door jambs. Internal drive screws, such as Allen Head set screws are positioned to pass through each aperture located under the removable door stops. The applied door stops are temporarily removed to allow access to the shim screws that will be adjusted for the frame installation. From the door side they are threaded through the threaded apertures in shim plates positioned inside the frames, and out the other side of the shim plates to pass out through the apertures on the opposite side of the jamb tube.

During installation, the installer places the frame assembly in the rough opening. He then screws the shim screw or screws out to bear against the inside of the adjacent sub-frame or masonry wall in the rough opening. The shim screws at the top of the frame will exert compression force against the ends of the header on both sides of the opening.

Then the shim screws at the bottom of the frame are also screwed out to exert compression force against the ends of the threshold on both sides of the frame. The frame will then be securely held in place in the opening so the doors can be attached to it. The shim screws may then be used to loosen as necessary and retightened in aligning and adjusting the frame so the doors are plumb and square in the opening with the required clearances for the proper operation of the doors. Once the door and frame assembly is positioned and fixed with the proper clearances, anchor screws and conventional shims maybe used to secure the frame in the rough opening. The door stops are reinstalled to cover up all the exposed fasteners. The procedure is a substantial savings in installation time and, therefore, costs.

The frame assembly that includes the adjustable shim screws may be formed of essentially any frame material. The frame may be formed of fiberglass or metal such as aluminum or steel for commercial or institutional applications. The frame may be formed of different materials with respect to the side vertical frame boards and the top horizontal frame piece. Typically, the entire frame is fabricated from the same or similar material. A frame assembly may or may not include a threshold across the horizontal bottom of the frame.

If the frame is formed of fiberglass or aluminum, the cross-width of the frame faces may be in the range of from about ½ to 12 inches and beyond. There are non-threaded holes that form apertures through the side frames. The apertures may be 1/32 to ¼ inches larger in diameter than a shim screw in order to allow the shim screws to pass freely through the frame walls on both sides when the screws are tightened in the shim plate. The hole is about 1 1/32 to 1⅜ inches in diameter cross section. The shim screw that is positioned in a shim plate in a vertical frame jamb has a length that is about the same as or longer than the thickness of the frame jamb in which it is positioned. The thickness of a frame is the distance from the inside face of the frame at the door to the outside face of the frame at a rough or cased door opening. An Allen head type screw with an internal drive, or any internal drive screw maybe used. In this way, the screw is physically embedded within the width of the frame face in shim plate inside the example of a hollow frame. The shim screw may extend outwardly from the frame but typically not too far so as to hinder insertion of the frame assembly in a rough opening and/or sub-frame.

If a metal frame includes an adjustable shim as described herein, for instance for a steel or aluminum door, that metal frame is often hollow. If the metal, vertical frame jamb is hollow, a threaded shim plate may be sized to fit across at least a portion of the inside the hollow space of the tube to contain the shim screw threaded through it with space on either to run wire on either side of the shim plate. Most of the frames jamb legs remain hollow along their length in order to facilitate other installation requirements that may include electrical wiring. The shim plate provides a body within the side frame in which the shim screw threads may be engaged substantially all across the thickness of the frame. Typically, this shim plate is formed of a plastic or fiberglass material, but it may be formed of wood or metal or other composite material. The shim screw apertures in the hollow tube frame jambs are not threaded across the metal. The shim plate is threaded, in one example, to support the threaded shim screw mounted inside the hollow, vertical frame jamb.

The aperture and shim screws may be positioned anywhere along the vertical height of the side of the vertical frame jambs that have a top end proximate a header and a bottom end proximate a threshold or temporary spreader bar. Typically each side of the frame would include two shim screws. In one example, a door frame may include one aperture proximate the top end and one aperture proximate the bottom end on each side of the door assembly. For instance, if a door has a nominal seven foot height doorway that it is filling, then shim screw holes may be placed at approximately one foot up from the bottom and one foot down from the top. The shim screw apertures may alternatively be about one inch to two feet from the top and bottom ends of the vertical frame jamb, or still further alternatively about three inches to eighteen inches from the top and/or bottom ends of the vertical frame jamb. Also, there may be just two shim screws or there may be three or more shim screws that are positioned in apertures along each of the vertical jamb lengths thereof. The apertures may be symmetrically spaced along the length of the side frame, or they may be placed wherever it is deemed to be favorable with respect to installation purposes. For instance, the screws and apertures may be positioned proximate to where the hinges will be located on the frame. Still further alternatively, there may be a plurality of apertures for anchor screws preformed along the length of the side frames between the two shim screws. The anchor screws are used in any one or more of the apertures that are deemed to be significant or important in securing that particular frame in a particular sub-frame or rough opening.

It is expected that these anchor screws will be positioned in apertures in the vertical door jambs of the frame, but they may also be placed in the header that is generally horizontal across the top of the door frame assembly and butted and connected on each end to the tops of the vertical frame jambs. There may be two or more anchor screws and apertures in the frame header. This positioning during the installation process permanently anchors the frame and door assembly in the opening.

Turning now to all of the figures, there is shown a sub-frame assembly 12 which is the rough opening in which a door 20 and adjustable frame assembly 10 is installed. The adjustable frame assembly 10 includes side frame pieces, the vertical frame jambs 14, and the top frame piece, the header 16. A door stop 15 is positioned around the inside face of the vertical frame jamb 14 and across the header. It covers the apertures 24 that pass through the width of the frame jamb from the stop side face 26 of the vertical frame jamb to the outside face 27 of the vertical frame jamb. There is also a threshold 18 across the bottom width of the door assembly 10. The doors 20 are shown. Shim screws 25 are illustrated as mounted in apertures 24 that are positioned relatively proximate the top ends 31 and bottom ends 32 of the vertical frame jambs 14 of the door assembly 10 that bear against the sub-frame 12. The shim screw 25 is shown extending across the width or face of the vertical frame jambs 14 from the inside face 26 to the outside face 27. In the figures, the shim screws 25 have a length that is greater than the thickness of the vertical frame jambs 14 and extend outwardly from the outside faces 27 of the vertical frame jambs. The shim screws 25 may be approximately the same width or, as shown, or slightly longer than the width of the face of the frame jambs 14 in order to provide compression between the frame and shim plate and the cased, or rough opening, to secure the door frame assembly 10 within a rough opening 12.

Figure 5:
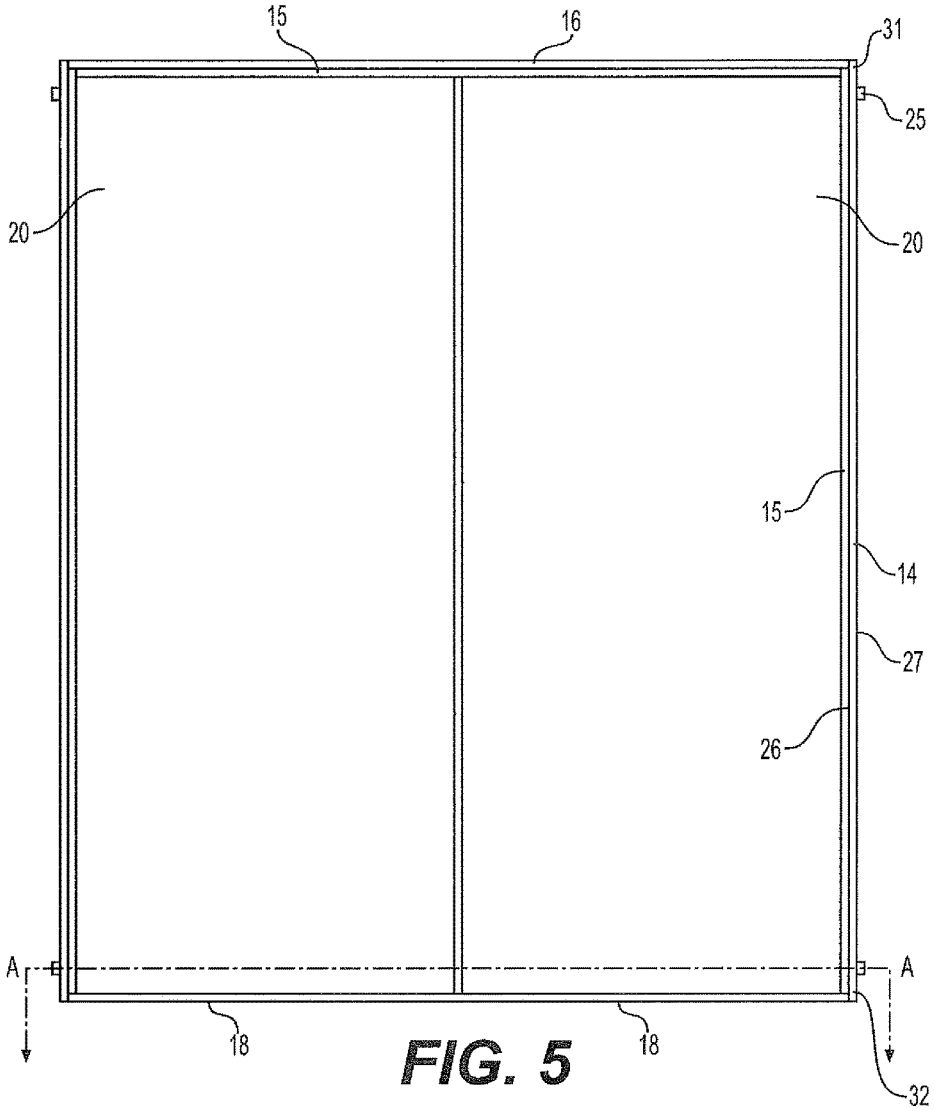
FIG. 5 is a front view of a pair of doors in an adjustable door frame assembly apart from any sub-frame.
Figure 5A:
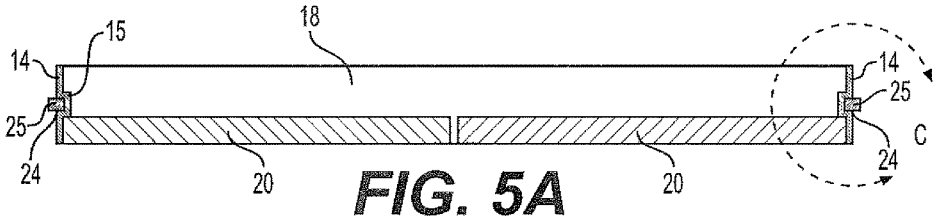
FIG. 5A is a top view of a cutaway from FIG. 5 taken along line A-A of FIG. 5.
Figure 5B:
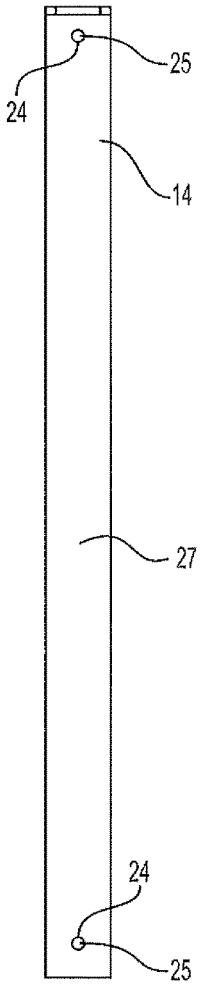
FIG. 5B is a side view of the adjustable door frame assembly shown in FIG. 5.
Figure 5C:
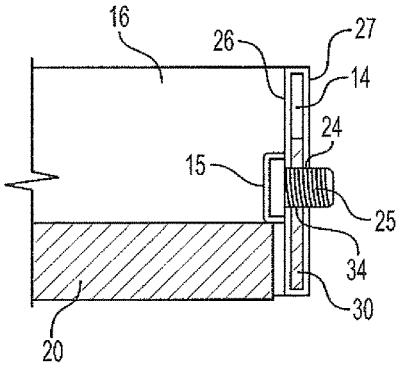
FIG. 5C is a close-up cut-away view of a corner of the adjustable door frame assembly illustrated in Detail C of FIG. 5A.
Figure 6:
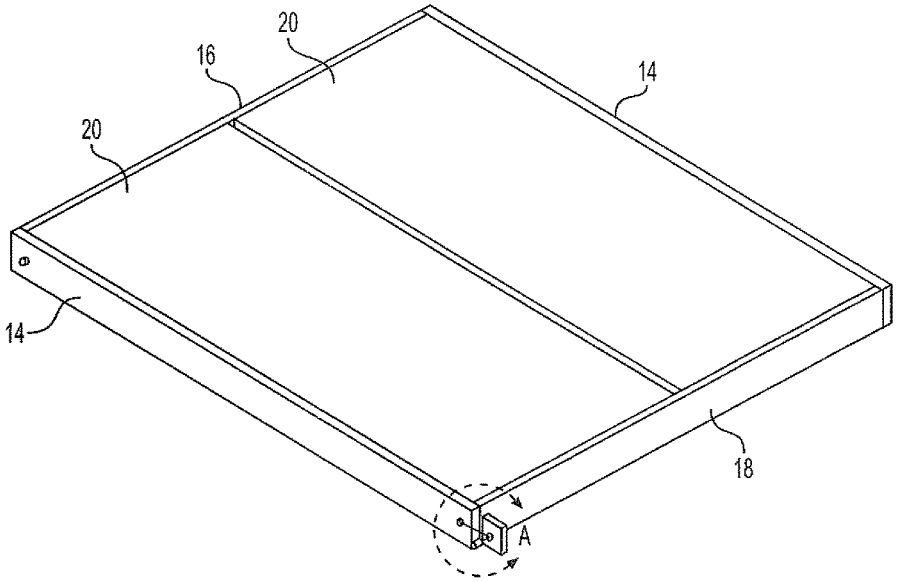
FIGS. 6 and 6A illustrate a perspective view of a door and frame assembly and a close-up, exploded view respectively of a shim plate and shim screw positioned into the hollow frame of a door frame assembly.
Figure 6A:
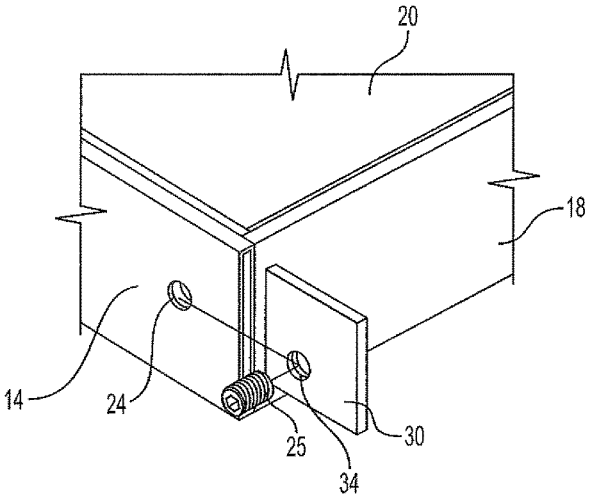
Figure 7:
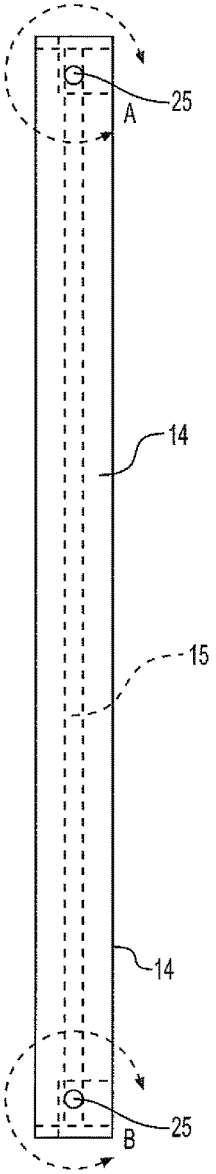
FIG. 7 is a side view of an adjustable door frame assembly with the shim plates shown in broken lines inside the hollow frame.
Figure 7A:
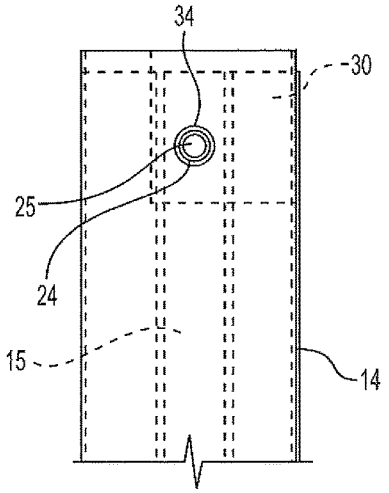
FIGS. 7A and 7B show the close-up side view detail if the shim plates and shim screws inside the side frames of the door assemblies as shown in Details A and B respectively in FIG. 7.
Figure 7B:
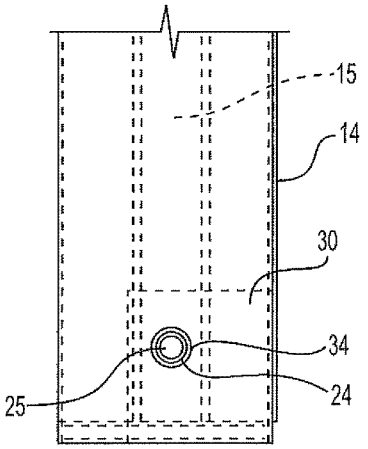

As is also shown, the side frame jambs 14 are a hollow structure, for instance, an aluminum rectangular tube frame. A shim plate 30 is shown inserted inside the top and bottoms of door frame jamb 14 in FIGS. 5B, 5C and 6A. The shim plate 30 includes a threaded aperture 34 that aligns with the aperture through 24 in both sides of door frame jamb 14. In this way, the shim screw 25 is threaded and supported across the entire width of the side frame jambs 14.

Other embodiments of the present invention will be apparent to those skilled in the art from consideration of the specification. It is intended that the specification and figures be considered as exemplary only, with a true scope and spirit of the invention being indicated by the claims.

That which is claimed is:

1. A door frame assembly comprising:

vertical frame jambs each having a top end and bottom end, one vertical frame jamb on each side of a door frame assembly and adapted to be installed in a substantially vertical position, each vertical frame jamb having a width between an inside face exposed to an open doorway and an outside face adapted to be exposed to a rough door opening;

a horizontal frame header butted and connected on opposite ends thereof to the top end of each vertical frame jamb;

wherein the vertical frame jambs are hollow, single piece, rectangular tubes and each have at least one first aperture therein that extends through and is open on both the inside face and outside face of the vertical frame jamb;

shim plates that are sized to fit entirely inside the hollow metal rectangular tubes into the hollow space between the inside face and the outside face of the first apertures that extends through the vertical frame jambs, and further wherein the shim plates comprise threaded second apertures that align with the first apertures on the inside face and outside face of the vertical frame jamb;

and a shim screw adapted to be mounted in the vertical frame jamb first apertures and shim plate threaded second aperture, and further adapted to be adjustable so that it the shim screw may be threaded to extend outwardly from the outside face of the vertical frame jamb to variably engage a rough door opening surface.

2. A door frame assembly as described in claim 1, wherein each vertical door jamb has two first apertures with one first aperture positioned proximate the top end and bottom end of each vertical frame jamb.

3. A door frame assembly as described in claim 1, wherein a length of each shim screw is substantially equal to the width of each corresponding vertical frame jamb.

4. A door frame assembly as described in claim 1, wherein the vertical frame jambs are formed of fiberglass.

5. A door frame assembly as described in claim 1, wherein the vertical frame jambs are comprised of metal.

6. A door frame assembly as described in claim 5, wherein the vertical frame jambs are formed of aluminum.

7. A door frame assembly as described in claim 5, wherein the vertical frame jambs are formed of steel.

8. A door frame assembly as described in claim 1, wherein the shim screw is an internal drive screw having a drive end that is open to the inside face of the vertical frame jamb.

9. A door frame assembly as described in claim 1, wherein when the shim screw is threaded into the threaded second aperture, the shim screw does not extend outwardly from the inside face of the vertical frame jamb.

* * * * *